US011255148B2

(12) United States Patent
Greci et al.

(10) Patent No.: US 11,255,148 B2
(45) Date of Patent: Feb. 22, 2022

(54) EXPANDABLE ELASTOMERIC SEALING LAYER FOR A RIGID SEALING DEVICE

(71) Applicant: Halliburton Energy Services, Inc., Houston, TX (US)

(72) Inventors: Stephen Michael Greci, Little Elm, TX (US); Michael Linley Fripp, Carrollton, TX (US); Pete Clement Dagenais, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 224 days.

(21) Appl. No.: 16/477,491

(22) PCT Filed: Apr. 23, 2018

(86) PCT No.: PCT/US2018/028934

§ 371 (c)(1),
(2) Date: Jul. 11, 2019

(87) PCT Pub. No.: WO2018/200407

PCT Pub. Date: Nov. 1, 2018

(65) Prior Publication Data

US 2021/0131210 A1 May 6, 2021

Related U.S. Application Data

(60) Provisional application No. 62/491,111, filed on Apr. 27, 2017.

(51) Int. Cl.
*E21B 23/06* (2006.01)
*E21B 33/12* (2006.01)

(52) U.S. Cl.
CPC ..... *E21B 23/06* (2013.01); *E21B 33/12* (2013.01)

(58) Field of Classification Search
CPC ..... E21B 23/06; E21B 33/12
See application file for complete search history.

(56) References Cited

U.S. PATENT DOCUMENTS 3,437,142 A * 4/1969 Conover ..... E21B 33/1277 166/277
4,227,573 A * 10/1980 Pearce ..... F16J 15/3284 166/153
4,253,676 A * 3/1981 Baker ..... E21B 33/1277 277/334
4,372,562 A * 2/1983 Carter, Jr. ..... E21B 33/1277 166/120

(Continued)

FOREIGN PATENT DOCUMENTS

DE 4202926 A1 8/1993

OTHER PUBLICATIONS

International Search Report and Written Opinion dated Aug. 8, 2018; International PCT Application No. PCT/US2018/028934.

*Primary Examiner* — Steven A Macdonald
(74) *Attorney, Agent, or Firm* — McGuireWoods LLP

(57) ABSTRACT

Included are wellbore sealing systems and methods of use. An example wellbore sealing system comprises a rigid sealing device capable of expansion and having an exterior having holes disposed therethrough; and an expandable sealing layer disposed around the rigid sealing device. The expandable sealing layer comprises an elastomeric layer and a reinforcing layer.

20 Claims, 6 Drawing Sheets

(56) References Cited

U.S. PATENT DOCUMENTS 4,424,861 A * 1/1984 Carter, Jr. ..... E21B 33/1277 166/120
4,428,592 A * 1/1984 Shaffer ..... E21B 33/06 251/1.2
4,524,825 A * 6/1985 Fore ..... E21B 33/1292 166/139
4,614,346 A * 9/1986 Ito ..... F16J 15/46 277/334
4,768,590 A * 9/1988 Sanford ..... E21B 33/1277 166/187
4,832,120 A * 5/1989 Coronado ..... E21B 33/1277 166/187
4,858,691 A * 8/1989 Ilfrey ..... E21B 43/088 166/278
4,917,183 A * 4/1990 Gaidry ..... E21B 43/082 166/278
4,941,511 A * 7/1990 Johansen ..... F16L 55/1283 138/89
5,050,678 A * 9/1991 Gaidry ..... E21B 43/082 166/278
5,115,864 A * 5/1992 Gaidry ..... E21B 43/082 166/228
5,119,862 A 6/1992 Maimets et al.
5,143,154 A * 9/1992 Mody ..... E21B 33/1277 166/187
5,150,753 A * 9/1992 Gaidry ..... E21B 43/04 166/228
5,186,215 A 2/1993 Gilleland
6,012,522 A 1/2000 Donnelly et al.
6,164,377 A * 12/2000 Roberts ..... E21B 7/06 166/118
6,250,385 B1 6/2001 Montaron
6,695,067 B2 * 2/2004 Johnson ..... E21B 33/128 166/387
7,331,581 B2 * 2/2008 Xu ..... E21B 33/1216 166/187
8,230,913 B2 * 7/2012 Hart ..... E21B 43/086 166/207
8,397,804 B2 * 3/2013 Hart ..... E21B 43/106 166/207
8,776,876 B2 * 7/2014 Hart ..... E21B 23/06 166/207
9,371,730 B2 6/2016 Corre et al.
9,732,581 B2 * 8/2017 Morehead ..... E21B 33/1216
10,053,963 B2 * 8/2018 Hart ..... E21B 43/086
10,550,670 B2 * 2/2020 Hart ..... E21B 43/108
2002/0092658 A1 * 7/2002 Johnson ..... E21B 43/08 166/384
2002/0107562 A1 * 8/2002 Hart ..... E21B 43/086 623/1.15
2005/0000692 A1 * 1/2005 Cook ..... E21B 33/12 166/300
2006/0037745 A1 * 2/2006 Hart ..... E21B 43/106 166/242.1
2006/0219400 A1 * 10/2006 Xu ..... E21B 33/1216 166/187
2011/0214855 A1 * 9/2011 Hart ..... E21B 43/106 166/242.1
2012/0073834 A1 3/2012 Lembcke
2012/0181017 A1 * 7/2012 Hart ..... E21B 43/103 166/207
2013/0220641 A1 * 8/2013 Fripp ..... E21B 43/12 166/386
2014/0190685 A1 * 7/2014 Frazier ..... E21B 33/1293 166/250.01
2014/0299331 A1 * 10/2014 Hart ..... E21B 43/106 166/380
2017/0370174 A1 * 12/2017 Yun ..... C08K 3/04
2018/0328152 A1 * 11/2018 Hart ..... E21B 23/06

* cited by examiner

EXPANDABLE ELASTOMERIC SEALING LAYER FOR A RIGID SEALING DEVICE

BACKGROUND

The present disclosure relates generally to a high-expansion sealing layer, and more particularly to a high-expansion sealing layer with mesh reinforcement that is used with a rigid sealing device for wellbore sealing operations.

High-expansion ratio rigid sealing devices (e.g., greater than 50% expansion) may be used to create seals in wellbores during wellbore sealing operations, (e.g., to seal a damaged casing, to form a multilateral junction, and the like). Generally, rigid sealing devises, such as an expandable mandrel or a pipe having holes, have gaps when fully expanded. These gaps may not allow for the formation of a sufficient seal. As such, a sealing layer may be needed to seal the gaps in the rigid sealing device.

However, the use of these sealing layers can have drawbacks. In one example, the sealing layer may not be expandable, for example, the sealing layer may be rolled in layers around the rigid sealing device. As the rigid sealing device expands, the sealing layer may be unrolled to provide a sealing layer around the expanded rigid sealing device. However, in some instances the sealing layer may fail to unroll. This may result in a failed seal and damage to the sealing layer and potentially the rigid sealing device. An expandable sealing layer may be used. However, as the expandable sealing layer is expanded by the rigid sealing device as it is positioned on an outer diameter of the rigid sealing device, the sealing layer may be extruded through the gaps in the rigid sealing device as the rigid sealing device expands. If the sealing layer is extruded through the gaps in the rigid sealing device, it may fail to form a sufficient seal, resulting in a failure of the wellbore sealing operation. Moreover, contact between the rigid sealing device and the sealing layer as it expands may degrade the sealing layer resulting in a decrease in the durability of the sealing layer. Degradation of the expandable sealing layer may induce leakage in the seal formed by the sealing layer. For example, the sealing layer may not be sufficient to withstand a target pressure differential in either direction and may fail prematurely.

Failure of a wellbore sealing operation may result in loss of productive time and the need for expensive remediation operations.

BRIEF DESCRIPTION OF THE DRAWINGS

Illustrative embodiments of the present invention are described in detail below with reference to the attached figures, which are incorporated by reference herein, wherein.

Figure 1A:
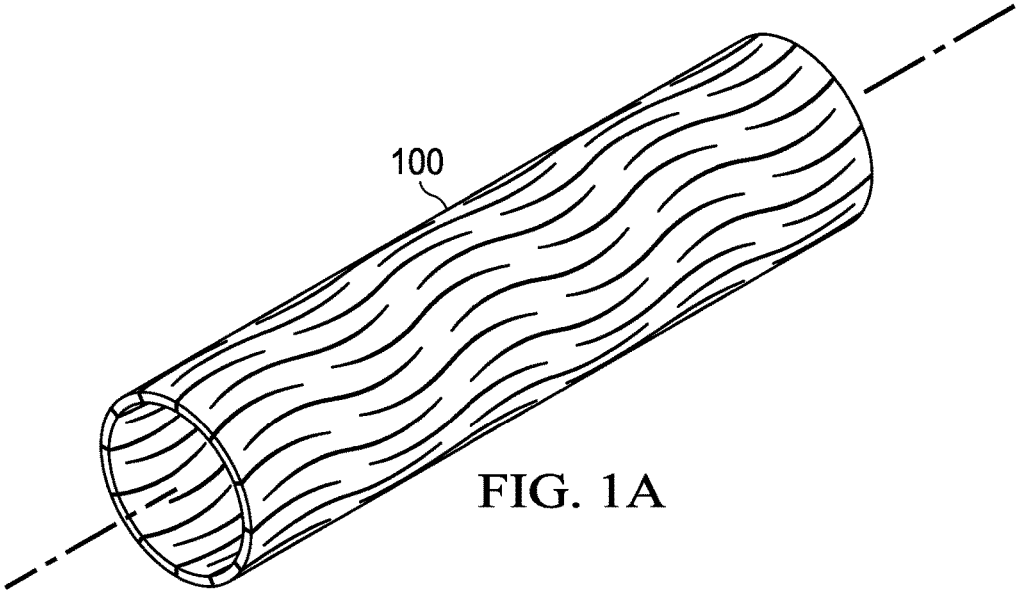
FIG. 1A is an isometric view of a bistable rigid sealing device in an unexpanded state in accordance with one or more examples described herein.

The illustrated figures are only exemplary and are not intended to assert or imply any limitation with regard to the environment, architecture, design, or process in which different embodiments may be implemented.

DETAILED DESCRIPTION

The present disclosure relates generally to a high-expansion sealing layer, and more particularly, to a high-expansion sealing layer with mesh reinforcement that is used with a rigid sealing device for wellbore sealing operations.

In the following detailed description of several illustrative examples reference is made to the accompanying drawings that form a part hereof and in which is shown by way of illustration specific examples that may be practiced. These examples are described in sufficient detail to enable those skilled in the art to practice them, and it is to be understood that other examples may be utilized and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims the terms "including" and "comprising" are used in an open-ended fashion and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Examples of the methods and systems disclosed herein comprise a rigid sealing device with at least part of its outer diameter covered with an expandable sealing layer. The expandable sealing layer comprises at least an elastomeric layer and a reinforcement layer. Advantageously, the expandable sealing layer may be used with any type of rigid sealing device. For example, the expandable sealing layer may be used with bistable and non-bistable rigid sealing devices. "Bistable," as used herein, refers to the bistable property of some rigid sealing devices wherein the expansion force changes with the amount of expansion. For example, the expansion force needed to expand a bistable device may decrease once a certain expansion distance is reached. In another example, the rate of increase of the expansion force needed to expand a bistable device may decrease once a certain expansion distance is reached. Moreover, the expandable sealing layer may be expanded by the expansion of the rigid sealing device. Further advantageously, the expandable sealing layer may resist extrusion through any gaps present in the expanding or fully expanded state of the rigid sealing device. Additionally, contact between the elastomeric layer and the rigid sealing device may be reduced such that the potential for degradation of the elastomeric layer during expansion of the rigid sealing device is reduced. As a further advantage, the expandable sealing layer has a high-expansion ratio (e.g., greater than 50%) and as such may be used in a wide variety of sealing operations and with a wide variety of rigid sealing devices. As another advantage, the expandable sealing layer may be able to span large gaps while still holding back pressure in both directions.

In some specific applications, the expandable sealing layer is disposed around an outer diameter of a rigid sealing device. The elastomeric layer of the expandable sealing layer is reinforced by the reinforcement layer. As such, the elastomeric layer may span any gaps present on the outer diameter of the rigid sealing device before expansion, during expansion, and after expansion of the rigid sealing device. The expandable sealing layer may seal said gaps in the rigid sealing device, restricting flow into and out of said gaps. Reinforcement via the reinforcement layer prevents extrusion of the elastomeric layer into the gaps. Moreover, the expandable sealing layer may seal around the outer diameter of the rigid sealing device forming a seal at the interface between this outer diameter and an adjacent sealing surface such as a casing, conduit, or wellbore wall. In this manner, the expandable sealing layer surrounding the rigid sealing device may be able to maintain a sealing force against pressure generated from a leak within the wellbore.

FIG. 1A is an isometric perspective view of a bistable rigid sealing device 100 in an unexpanded or run-in-hole configuration. The bistable rigid sealing device 100 may be introduced into a wellbore and conveyed to a desired depth within the wellbore. The bistable rigid sealing device 100 may be transported as part of a conduit string, or through another method, for example via a conveyance line. The bistable rigid sealing device 100 may be used to form a seal in a sealing operation. For example, the bistable rigid sealing device 100 may be positioned in a portion of the conduit in which a seal may be desired, such as in an area where the casing or a conduit has a leak or is otherwise insufficient for restricting fluid and/or pressure as is desired. Once deployed, the bistable rigid sealing device 100 is expanded until it is sufficiently pressured against an adjacent sealing surface. The expandable sealing layer (not pictured for clarity of illustration) is disposed on the illustrated outer diameter of the bistable rigid sealing device 100. As the bistable rigid sealing device 100 expands, so does the expandable sealing layer. The elastomeric layer of the expandable sealing layer directly contacts the adjacent sealing surface thereby forming a seal at the interface. The formed seal may be sufficient to stop or restrict flow from the aforementioned leak in both directions.

Figure 1B:
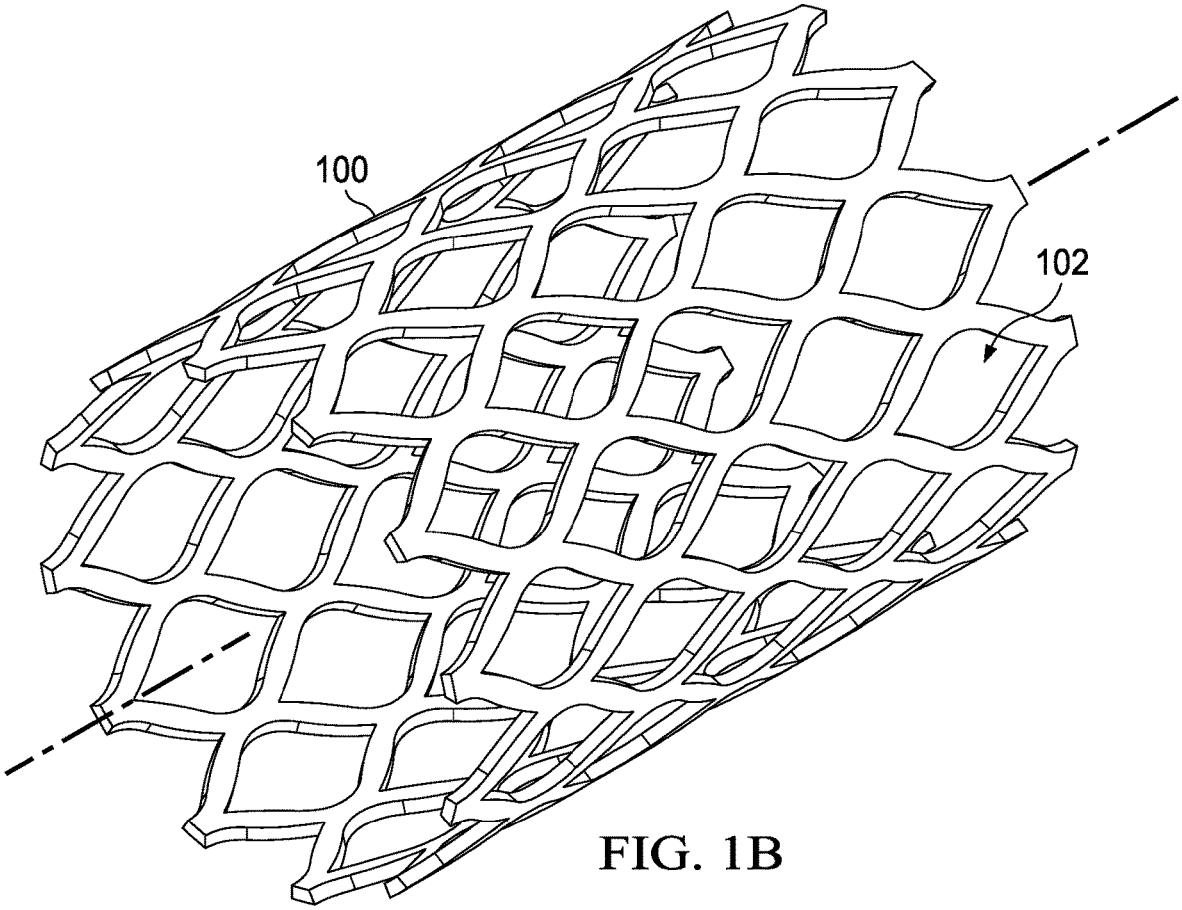
FIG. 1B is an isometric view of the bistable rigid sealing device of FIG. 1A in an expanded state in accordance with one or more examples described herein.

FIG. 1B is an isometric perspective view of the bistable rigid sealing device 100 in the fully expanded configuration. As illustrated, the expansion of the bistable rigid sealing device 100 enlarges and/or creates gaps 102 disposed on and through the exterior of the bistable rigid sealing device 100. As discussed above, the expandable sealing layer (not pictured for clarity of illustration) is disposed on the illustrated outer diameter of the bistable rigid sealing device 100 and would therefore be positioned over the gaps 102, covering said gaps 102. As pressure increases against the elastomeric layer of the expandable sealing layer, the elastomeric layer would be extruded into and potentially through the gaps 102 as the bistable rigid sealing device 100 is expanded. Said extrusion may potentially result in a failure of the expandable sealing layer to form a sufficient seal for restricting fluid and/or pressure in both directions. The inclusion of a reinforcement layer in the expandable sealing layer prevents the extrusion of the elastomeric layer into the gaps 102. The reinforcement layer may be disposed between the elastomeric layer and the outer diameter of the bistable rigid sealing device 100. Alternatively, the reinforcement layer may be disposed within the elastomeric layer and the elastomeric layer is molded around the reinforcement layer. As such, contact between the bistable rigid sealing device 100 and the elastomeric layer is reduced or nonexistent at the sealing surface of the elastomeric layer, resulting in reduced degradation of the elastomeric layer from the expansion of the bistable rigid sealing device 100, as well as preventing extrusion of the elastomeric layer through the gaps 102 of the bistable rigid sealing device 100. When sealing a leak within the well, the gaps 102 are covered such that the elastomeric layer does not extrude through the gaps 102 when experiencing the pressure from the leak within the well. While the present specification makes reference to the bistable rigid sealing device 100, the expandable sealing layer discussed in detail below with reference to FIGS. 3-6 may also be used with any expandable sealing device. The bistable rigid sealing device 100 may be unexpanded and converted to its unexpanded configuration as illustrated in FIG. 1A when no longer desired for use.

Figure 2A:
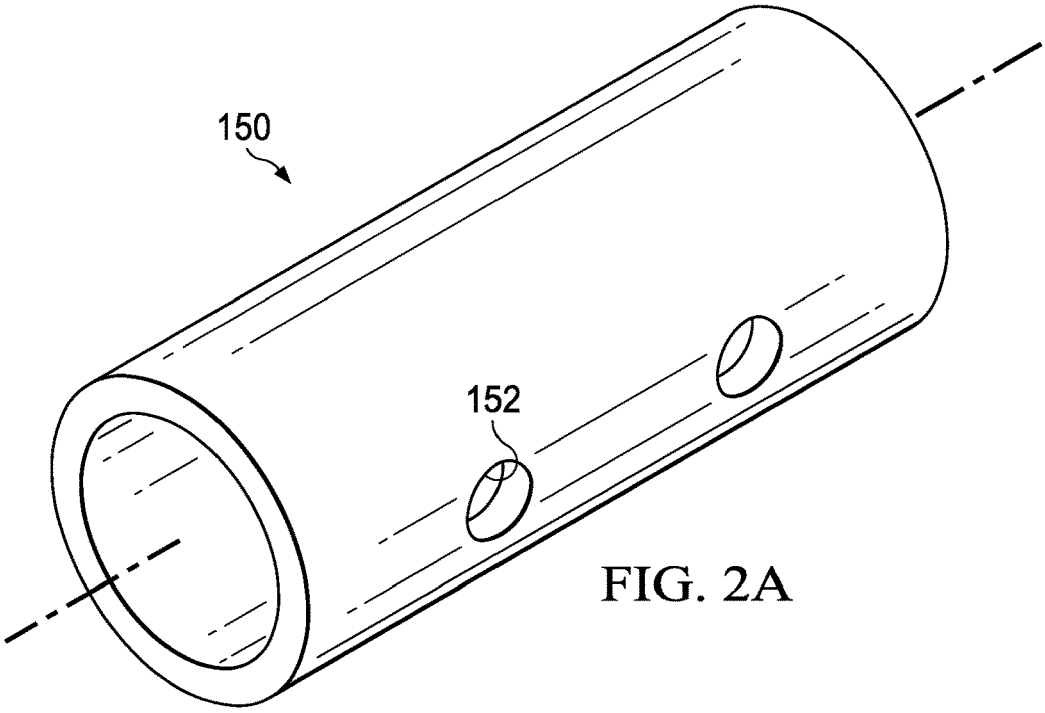
FIG. 2A is an isometric view of a non-bistable rigid sealing device in an unexpanded state in accordance with one or more examples described herein.

FIG. 2A is an isometric illustration of an alternative example of a rigid sealing device. This specific example of a rigid sealing device is not bistable. The non-bistable rigid sealing device 150 comprises a metal pipe having substantially circular-shaped holes 152 disposed on and through the exterior of the non-bistable rigid sealing device 150. The non-bistable rigid sealing device 150 is illustrated in its run-in-hole configuration. The non-bistable rigid sealing device 150 may be introduced into a wellbore and conveyed to a desired depth within the wellbore. The non-bistable rigid sealing device 150 may be transported as part of a conduit string, or through another method, for example, via a conveyance line. The non-bistable rigid sealing device 150 may be used to form a seal in a sealing operation. For example, the non-bistable rigid sealing device 150 may be positioned in a portion of the conduit in which a seal may be desired, for example, in an area where the casing or a conduit has a leak or is otherwise insufficient for restricting fluid and/or pressure as is desired. Once deployed, the non-bistable rigid sealing device 150 is expanded until it is sufficiently pressured against an adjacent sealing surface. The expandable sealing layer (not pictured for clarity of illustration) is disposed on the illustrated outer diameter of the non-bistable rigid sealing device 150. As the non-bistable rigid sealing device 150 expands, so does the expandable sealing layer. The elastomeric layer of the expandable sealing layer directly contacts the adjacent sealing surface thereby forming a seal at the interface. The formed seal may be sufficient to stop or restrict flow from the aforementioned leak in both directions.

Figure 2B:
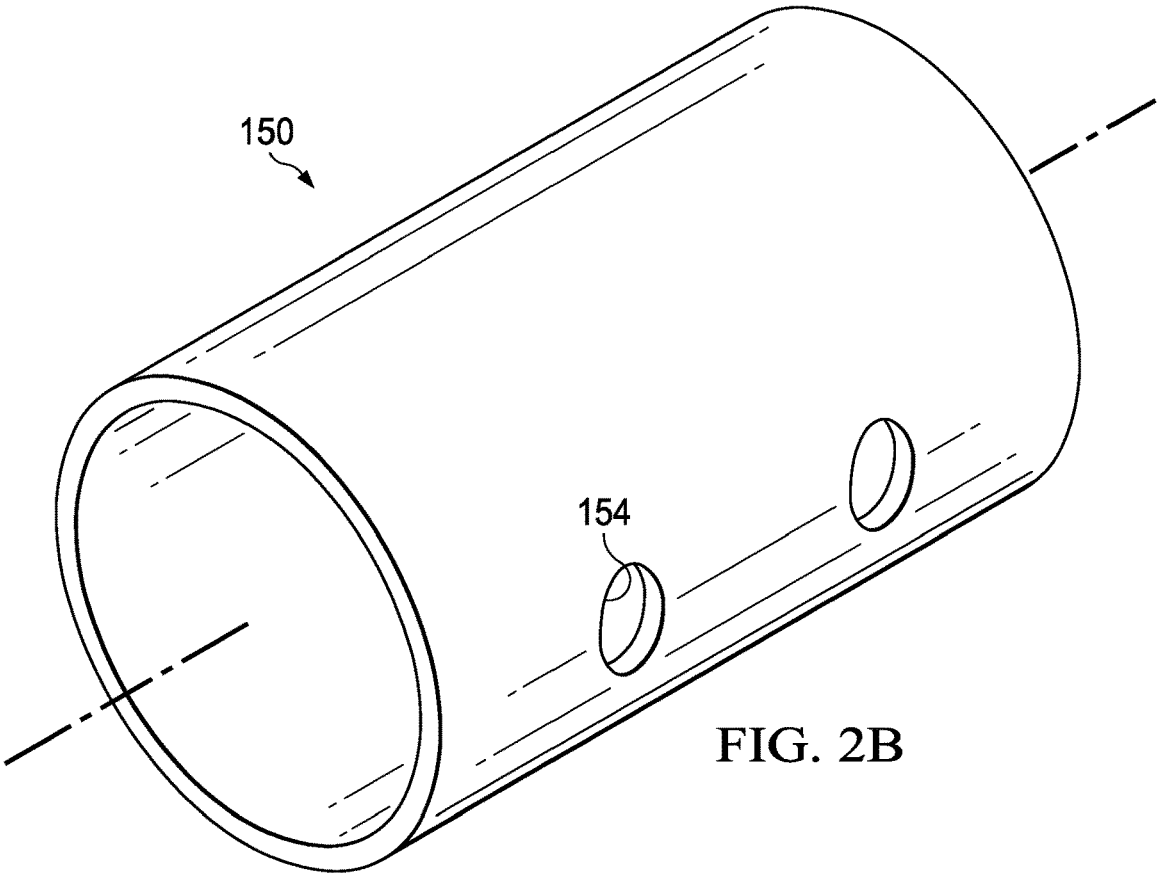
FIG. 2B is an isometric view of the non-bistable rigid sealing device of FIG. 2A in an expanded state in accordance with one or more examples described herein.

FIG. 2B is an isometric perspective view of the non-bistable rigid sealing device 150 in the fully expanded configuration. As illustrated, the expansion of the non-bistable rigid sealing device 150 enlarges the substantially circular-shaped holes 152 illustrated in FIG. 2A, stretching said substantially circular-shaped holes 152 to form the illustrated substantially oval-shaped holes 154 disposed on and through the exterior of the non-bistable rigid sealing device 150. As discussed above, the expandable sealing layer (not pictured for clarity of illustration) is disposed on the illustrated outer diameter of the non-bistable rigid sealing device 150 and would therefore be positioned over the substantially circular-shaped holes 152 in FIG. 2A and the substantially oval-shaped holes 154 in FIG. 2B. The expandable sealing layer would thus cover both the substantially circular-shaped holes 152 and the substantially oval-shaped holes 154. As pressure increases against the elastomeric layer of the expandable sealing layer, the elastomeric layer would be extruded into and potentially through the substantially oval-shaped holes 154 as the non-bistable rigid sealing device 150 is expanded. Said extrusion may potentially result in a failure of the expandable sealing layer to form a sufficient seal for restricting fluid and/or pressure in both directions. The inclusion of a reinforcement layer in the expandable sealing layer prevents the extrusion of the elastomeric layer into the substantially oval-shaped holes 154. The reinforcement layer may be disposed between the elastomeric layer and the outer diameter of the non-bistable rigid sealing device 150. Alternatively, the reinforcement layer may be disposed within the elastomeric layer and the elastomeric layer is molded around the reinforcement layer. As such, contact between the non-bistable rigid sealing device 150 and the elastomeric layer is reduced or nonexistent at the sealing surface of the elastomeric layer, resulting in reduced degradation of the elastomeric layer from the expansion of the non-bistable rigid sealing device 150, as well as preventing extrusion of the elastomeric layer through the substantially oval-shaped holes 154 of the non-bistable rigid sealing device 150. When sealing a leak within the well, the substantially oval-shaped holes 154 are covered such that the elastomeric layer does not extrude through the substantially oval-shaped holes 154 when experiencing the pressure from the leak within the well. As the non-bistable rigid sealing device 150 is non-bistable, the non-bistable rigid sealing device 150 may not be unexpanded and converted to its unexpanded configuration as illustrated in FIG. 2A.

It is to be understood that although FIGS. 2A and 2B illustrate substantially circular-shaped holes 152 and substantially oval-shaped holes 154 respectively, that these are but one example of a shape which may be selected to impart a void space within the non-bistable rigid sealing device 150 as desired. As such, any shape of void space may be disposed in the non-bistable rigid sealing device 150 may be used as desired. For example, the non-bistable rigid sealing device 150 may instead comprise a narrow slot-like shape, which may expand into a diamond-like shape when the non-bistable rigid sealing device 150 is expanded. Moreover, it is to be understood that a combination of different void space shapes may also be used in some examples. The shape selected for the void space should allow the non-bistable rigid sealing device 150 to be expanded as desired. With the benefit of this disclosure, one of ordinary skill in the art will be readily able to create a void space of any desired shape in the non-bistable rigid sealing device 150 such that the non-bistable rigid sealing device 150 may be expanded when and as desired.

Figure 3:
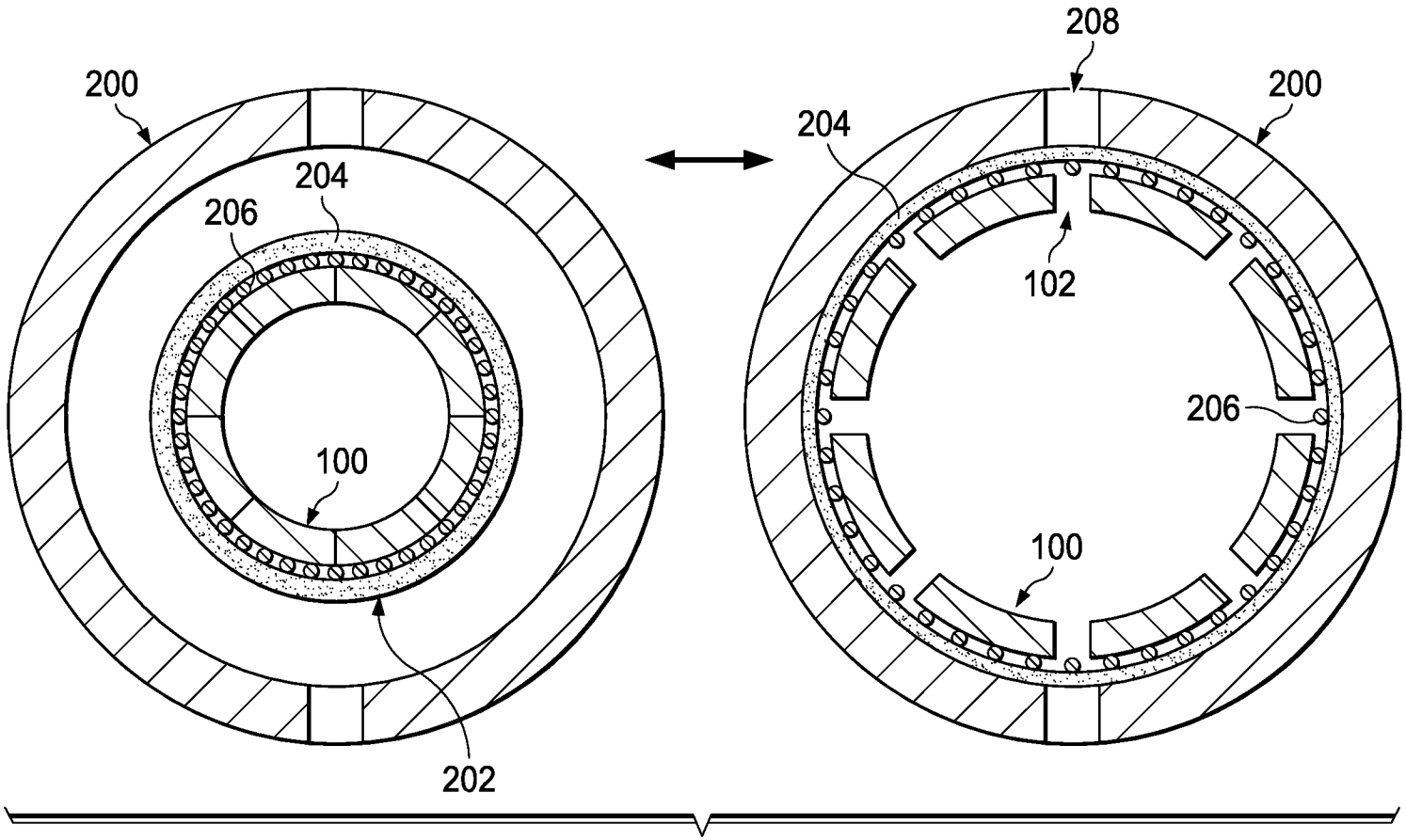
FIG. 3 is a cross-sectional view of the bistable rigid sealing device of FIG. 1 in both the unexpanded state and the expanded state within a casing or openhole in accordance with one or more examples described herein.

FIG. 3 is a cross-section illustration of the bistable rigid sealing device 100 of FIGS. 1A and 1B. The bistable rigid sealing device 100 is disposed within a cased or openhole wellbore 200. The bistable rigid sealing device 100 is illustrated in both the unexpanded state and the expanded state. Positioned along an outer diameter of the bistable rigid sealing device 100 is an expandable sealing layer 202. The expandable sealing layer 202 comprises an elastomeric layer 204 and a reinforcement layer 206. The elastomeric layer 204 may comprise any elastomeric material sufficient for use in the expandable sealing layer 202 disclosed herein. In some examples, the elastomeric material may be a swellable material. In some alternative examples, the elastomeric material may be a non-swellable material. The swellable material may be swellable in wellbore fluids. For example, the swellable materials may swell due to contact with aqueous or oleaginous fluids. In some examples, the elastomeric material may comprise a composite material. The composite material may comprise any combination of swellable and/or non-swellable materials. Examples of the elastomeric material may include, but are not limited to, ethylene propylene diene monomer rubber, nitrile butadiene, styrene butadiene, any butyl rubber (e.g., brominated butyl rubber, chlorinated butyl rubber, etc.), any polyethylene rubber (e.g., chlorinated polyethylene rubber, sulphonated polyethylene, chlor-sulphonated polyethylene, etc.), natural rubber, ethylene propylene monomer rubber, peroxide cross-linked ethylene propylene monomer rubber, sulfur cross-linked ethylene propylene monomer rubber, ethylene vinyl acetate rubber, hydrogenized acrylonitrile-butadiene rubber, acrylonitrile butadiene rubber, carboxylated acrylonitrile butadiene rubber, isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, the like, composites thereof, and any combination thereof.

Should the elastomeric layer 204 be made from a swellable rubber, any elastic recoil in the rigid sealing device may be filled by the swellable rubber. A sealing surface of the elastomeric layer 204 may be textured, such as with circumferential ridges, to accommodate any elastic recoil. Alternatively, the sealing surface of the elastomeric layer 204 may be smooth. In an alternative example, the elastomeric layer 204 comprises a plastic material.

In examples, the elastomeric layer 204 may be glued, injection molded, sprayed on, or otherwise connected to a woven, knitted, or welded reinforcement layer 206. The reinforcement layer 206 may be made from any of several oil and gas compatible materials. The reinforcement layer may reinforce the elastomeric layer 204 such that the elastomeric layer 204 may span large gaps 102 in the expanded bistable rigid sealing device 100 as well as any gaps 208 in the cased or openhole wellbore 200 without extrusion through said gaps 102 and 208.

With continued reference to FIG. 3, the reinforcement layer 206 may be designed specifically for high expansion so the expandable sealing layer 202 may be slid over the bistable rigid sealing device 100, or a non-bistable rigid sealing device (e.g., non-bistable rigid sealing device 150 as illustrated in FIG. 2), prior to expansion as a tubular. The reinforcement layer 206 may include elasticity to accommodate elastic recoil from the base structure. The bistable rigid sealing device 100 may then be expanded, resulting in expansion of the expandable sealing layer 202. Once the expandable sealing layer 202 contacts an inner diameter of the cased or openhole wellbore 200, it may be trapped between the casing and the exterior of the bistable rigid sealing device 100 as the bistable rigid sealing device 100 is pressured in the radial direction. The reinforcement layer 206 may prevent the elastomeric layer 204 from extruding through any gaps 102 during the expansion of the bistable rigid sealing device 100 or other structure. To limit extrusion of the elastomeric layer 204 through the gaps 102, any gaps created in the reinforcement layer 206 are smaller than the gaps 102 of the bistable rigid sealing device 100. The reinforcement layer 206 may also help prevent extrusion in the burst direction if there are gaps 208 in the cased or openhole wellbore 200, such as with an inflow control device (hereafter "ICD") and/or when the well is exposed to burst pressure. Further, the reinforcement layer 206 may crush to provide an even pressure even when a borehole is not round or when the bistable rigid sealing device 100 is not round.

The resulting expandable sealing layer 202 enables an expansion ratio of greater than 20% of an expandable rigid sealing device and the expandable sealing layer 202 while preventing leaks from the cased or openhole wellbore 200. In some examples, the expandable sealing layer 202 may also be suited for expansion ratios greater than 30%.

In examples, the reinforcement layer 206 comprises a mesh. The mesh of the reinforcement layer 206 may comprise any sufficient mesh pattern. Examples of mesh patterns include, but are not limited to, chain link, chain mail, knitted, plain double, twill square, twill dutch, reverse plain dutch, plain dutch, or any other type of woven pattern. The mesh could be a lock crimp, double crimp, intercrimp, or a flat top style. The weave may be produced with wires, stranded wires (to make a stranded weave), cables, or shaped wires (ribbons). The mesh may be constructed with warp and weft wires, whereas braided tubes have no weft wires.

Figure 4A:
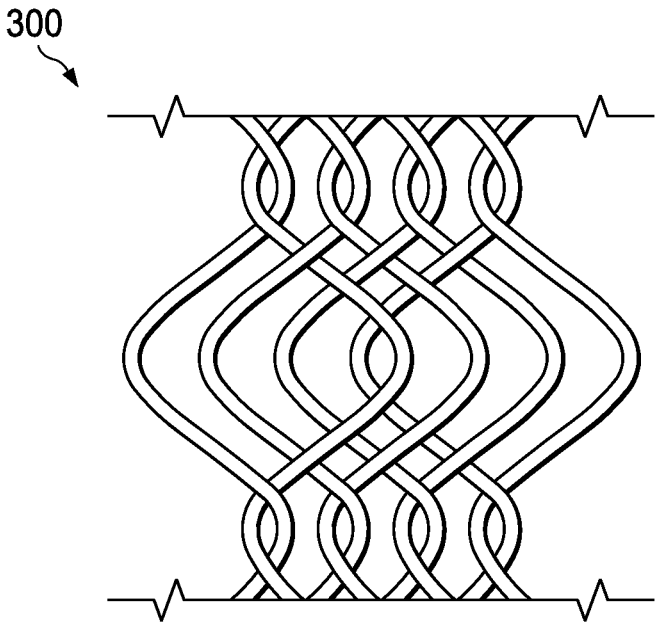
FIG. 4A is an orthogonal view of a chain link fence type mesh used to support an elastomeric sealing layer when a rigid sealing device is in the unexpanded state in accordance with one or more examples described herein.

FIG. 4A is an orthogonal view of another specific example of a mesh. This mesh example is a chain link or chain link fence type mesh 300 used to provide the reinforcement layer (e.g., reinforcement layer 206 as illustrated in FIG. 3). The illustration of FIG. 4A illustrates the mesh in the unexpanded configuration, i.e., when the expandable sealing layer is unexpanded.

The chain link or chain link fence type mesh 300 may be constructed from a variety of metals including, but not limited to, steel, stainless steel, aluminum alloy, magnesium alloy, nickel alloy (hastelloy, Inconel, monel), copper alloy (brass, bronze), titanium alloy, composites thereof, or any combination thereof. The metal may be plated or clad, such as galvanized steel. The chain link or chain link fence type mesh 300 may be a non-metal including, but not limited to, a polymer, a glass, a ceramic, a composite thereof, or any combination thereof. Non-metallic options for use as the chain link or chain link fence type mesh 300 include polyether ether ketone fiber (hereafter "PEEK"), polytetrafluoroethylene fiber, carbon fiber, graphite fiber, Kevlar® fiber, silica yarn, glass fiber, composites thereof, or any combination thereof. KEVLAR is a registered trademark of the E. I. du Pont de Nemours and Company of Wilmington, Del. In one example, the non-metallic option for the chain link or chain link fence type mesh 300 may a hard rubber, such as a high durometer hydrogenated nitrile butadiene rubber (hereafter "HNBR"). In preferred examples, these materials may be chemically compatible with the oil and gas fluids located within the well.

Figure 4B:
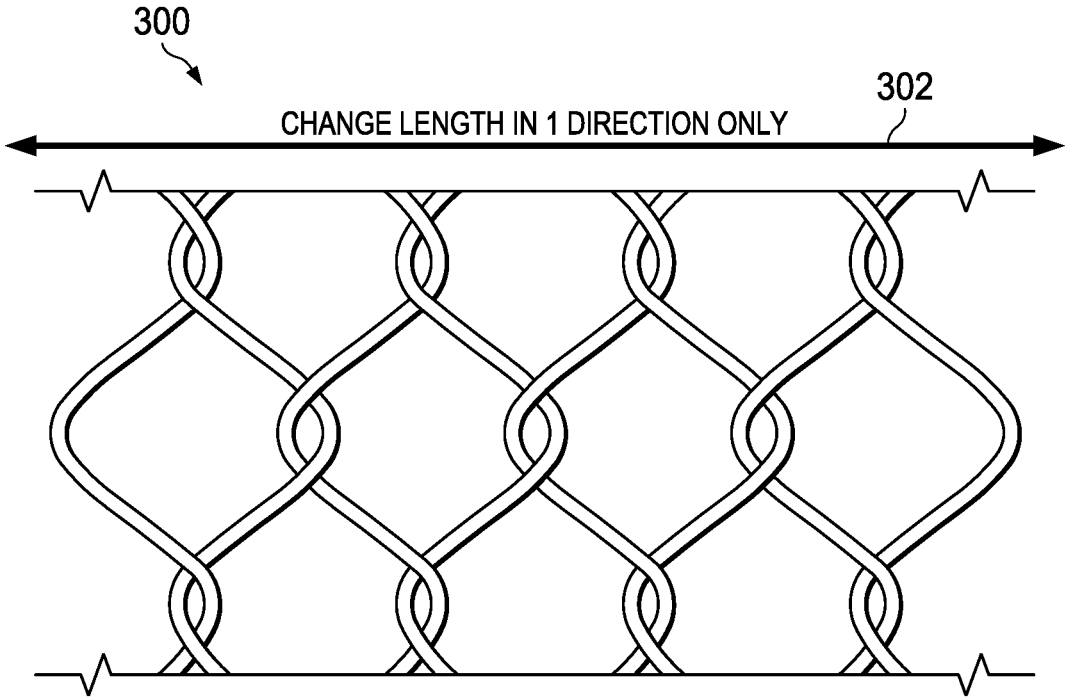
FIG. 4B is an orthogonal view of the chain link fence type mesh of FIG. 4A when a rigid sealing device is in the expanded state in accordance with one or more examples described herein.

FIG. 4B is an orthogonal view of the chain link fence type mesh 300 when the reinforcement layer is expanded, i.e., when the expandable sealing layer is expanded. As illustrated, the chain link or chain link fence type mesh 300 expands in only a single direction in this specific example. Each link of the chain link fence type mesh 300 provides a specific amount of expansion in a direction 302 available for the expandable sealing layer to expand.

Figure 5:
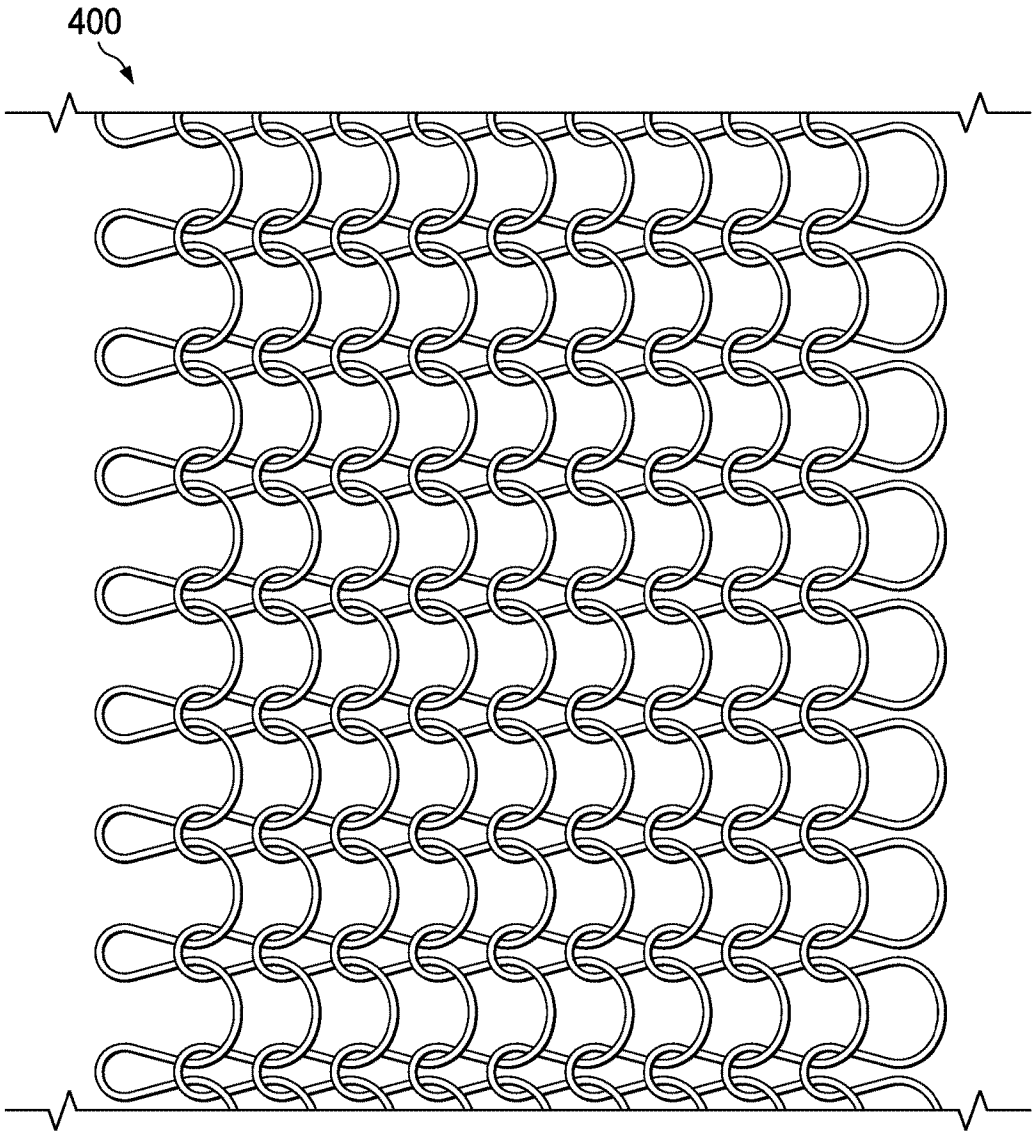
FIG. 5 is an orthogonal view of a knitted mesh used to support the elastomeric layer when a rigid sealing device is in the expanded state in accordance with one or more examples described herein.

FIG. 5 is an orthogonal view of another specific example of a mesh. This mesh example is a knitted mesh 400 used to provide the reinforcement layer (e.g., reinforcement layer 206 as illustrated in FIG. 3). In the illustrated example, the knitted mesh 400 is in an expanded state. The expanded state of the knitted mesh 400 occurs when the rigid sealing device is forced into the expanded state, and the expansion of the rigid sealing device induces expansion of the expandable sealing layer. In some examples, the knitted mesh 400 may have a higher expansion ratio than a woven mesh, such as the chain link or chain link fence type mesh 300 described above with reference to FIGS. 4A and 4B. The knitted mesh 400 may include any number of interlocked spring-like loops. Typically the knitted mesh 400 is an interlocking asymmetrical loop of wire. The knitted mesh 400 may be knitted into a tube to surround a rigid sealing device.

The knitted mesh 400 may be constructed from a variety of metals including, but not limited to, steel, stainless steel, aluminum alloy, magnesium alloy, nickel alloy (hastelloy, Inconel, monel), copper alloy (brass, bronze), titanium alloy, composites thereof, or any combination thereof. The metal may be plated or clad, such as galvanized steel. The knitted mesh 400 may be a non-metal including, but not limited to, a polymer, a glass, a ceramic, a composite thereof, or any combination thereof. Non-metallic options for use as the knitted mesh 400 include polyether ether ketone fiber (hereafter "PEEK"), polytetrafluoroethylene fiber, carbon fiber, graphite fiber, Kevlar® fiber, silica yarn, glass fiber, composites thereof, or any combination thereof. KEVLAR is a registered trademark of the EI. du Pont de Nemours and Company of Wilmington, Del. In one example, the non-metallic option for the knitted mesh 400 may a hard rubber, such as a high durometer hydrogenated nitrile butadiene rubber (hereafter "HNBR"). In preferred examples, these materials may be chemically compatible with the oil and gas fluids located within the well.

Figure 6:
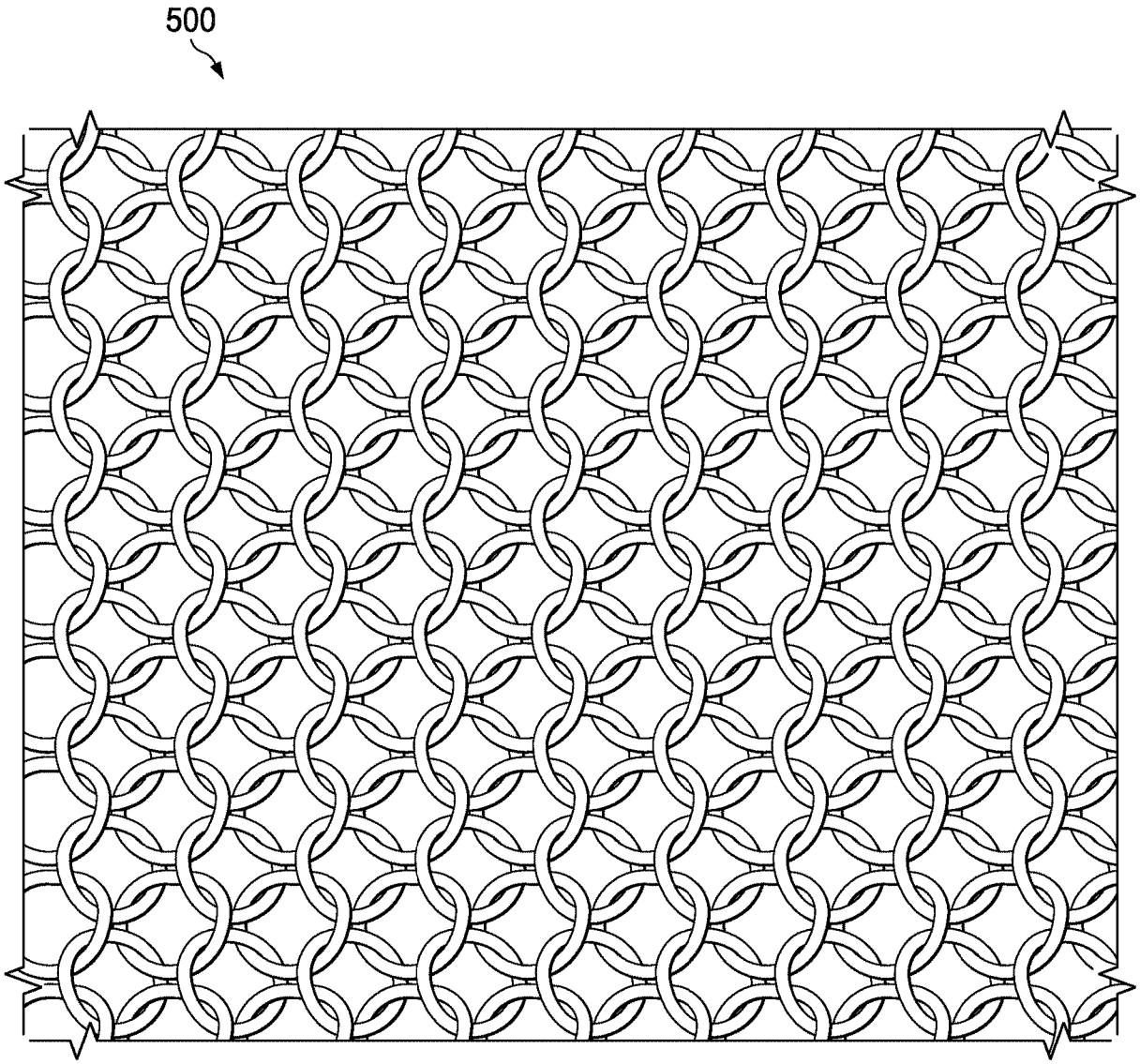
FIG. 6 is an orthogonal view of a chain mail mesh used to support the elastomeric layer when a rigid sealing device is in the expanded state in accordance with one or more examples described herein.

FIG. 6 is an orthogonal view of another specific example of a mesh. This mesh example is a chain mail mesh 500 used to provide the reinforcement layer (e.g., reinforcement layer 206 as illustrated in FIG. 3). In the illustrated example, the chain mail mesh 500 is in an expanded state. The expanded state of the chain mail mesh 500 occurs when the rigid sealing device is forced into the expanded state, and the expansion of the rigid sealing device induces expansion of the expandable sealing layer.

The chain mail mesh 500 may be constructed from a variety of metals including, but not limited to, steel, stainless steel, aluminum alloy, magnesium alloy, nickel alloy (hastelloy, Inconel, monel), copper alloy (brass, bronze), titanium alloy, composites thereof, or any combination thereof. The metal may be plated or clad, such as galvanized steel. The chain mail mesh 500 may be a non-metal including, but not limited to, a polymer, a glass, a ceramic, a composite thereof, or any combination thereof. Non-metallic options for use as the chain mail mesh 500 include polyether ether ketone fiber (hereafter "PEEK"), polytetrafluoroethylene fiber, carbon fiber, graphite fiber, Kevlar® fiber, silica yarn, glass fiber, composites thereof, or any combination thereof. KEVLAR is a registered trademark of the E.I. du Pont de Nemours and Company of Wilmington, Del. In one example, the non-metallic option for the chain mail mesh 500 may a hard rubber, such as a high durometer hydrogenated nitrile butadiene rubber (hereafter "HNBR"). In preferred examples, these materials may be chemically compatible with the oil and gas fluids located within the well.

It should be clearly understood that the examples described in FIGS. 1-6 are but merely a few examples of the principles of this disclosure in practice, and a wide variety of other examples are possible. Therefore, the scope of this disclosure is not limited at all to the details of FIGS. 1-6 described herein.

With reference to any of FIGS. 1-6, in some examples, the elastomeric layer may be positioned proximate the reinforcement layer without a bonded connection. In such an example, expansion of the rigid sealing device induces the expansion of the reinforcement layer which, in turn, induces expansion of the elastomeric layer.

In some alternative examples, the elastomeric layer and/or the reinforcement layer of the expandable sealing layer, may comprise degradable materials. A portion of or the entirety of the elastomeric layer and/or the reinforcement layer may comprise the degradable materials. These degradable materials may degrade in wellbore fluids, for example, via hydrolysis, oxidation-reduction reactions, galvanic corrosion, acid-base reactions, and the like. An example of a substance that decomposes via hydrolysis is magnesium. In water, magnesium undergoes a hydrolytic decomposition to form magnesium hydroxide "$Mg(OH)_2$" and hydrogen "$H_2$" gas. However, when magnesium hydrolyzes into $Mg(OH)_2$, the pH of the surrounding water increases, which may halt or slow the hydrolysis of un-hydrolyzed magnesium. By way of another example, a substance that undergoes galvanic corrosion is aluminum. When an electrically conductive path exists between aluminum and a second substance of a different metal or metal alloy and both substances are in contact with an electrolyte, the aluminum may function as an anode and galvanically corrode should the second substance be a sufficient cathodic material. The pH of the electrolyte can become neutral in this process, which may halt or slow the galvanic corrosion of any uncorroded aluminum anode.

In some further alternative examples, the degradable materials may degrade due to the wellbore exceeding a specific threshold of a wellbore condition. For example, the degradable materials may melt should a temperature in the wellbore exceed the melting point of the degradable materials.

In another alternative example, the rigid sealing device may comprise degradable materials. In this specific example, the expandable sealing layer may or may not also comprise degradable materials. A portion of or the entirety of the rigid sealing device may comprise the degradable materials. The degradable materials may be any of the degradable materials discussed above with regard to the expandable sealing layer.

The expandable sealing layer and the rigid sealing device may be used in wellbore sealing operations. Examples of wellbore sealing operations include, but are not limited to, patching damages casing and conduits, sealing while forming multilateral junctions, blocking a perforation or an open sleeve, refracturing, or more generally, in any operation in which a seal may be needed to restrict fluid flow into or out of a wellbore zone, a conduit, a formation, etc. The expandable sealing layer and the rigid sealing device may also be used to isolate zones downhole of the rigid sealing device.

The expandable sealing layer and the rigid sealing device may be used in any wellbore and in any portion of any wellbore as described above (e.g., cased, uncased, openhole, horizontal, slanted, vertical, etc.). Although not illustrated, it is to be understood that the principles described herein are equally applicable to subsea operations that employ floating or sea-based platforms and rigs without departing from the scope of the disclosure.

It is also to be recognized that the disclosed expandable sealing layer and the rigid sealing device, methods of use, and corresponding systems may also directly or indirectly affect the various downhole equipment and tools that may contact the expandable sealing layer and the rigid sealing device. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIGS. 1-6.

Provided are wellbore sealing systems in accordance with the disclosure and the illustrated FIGS. An example wellbore sealing system comprises a rigid sealing device capable of expansion and having an exterior having holes disposed therethrough; and an expandable sealing layer disposed around the rigid sealing device. The expandable sealing layer comprises an elastomeric layer and a reinforcing layer.

Additionally or alternatively, the wellbore sealing system may include one or more of the following features individually or in combination. The elastomeric layer may comprise a swellable rubber. The elastomeric layer may comprise a non-swellable rubber. The reinforcing layer may comprise a mesh selected from the group consisting of a chain link mesh, a knitted mesh, a chain mail mesh, a plain double mesh, a twill square mesh, a twill dutch mesh, a reverse plain dutch mesh, a plain dutch mesh, a lock crimp mesh, a double crimp mesh, an intercrimp mesh, a flat top style mesh, or any combination thereof. The elastomeric layer may be bonded to the reinforcing layer. The elastomeric layer may not be bonded to the reinforcing layer. The reinforcing layer may comprise a mesh comprising a material selected from the group consisting of steel, stainless steel, aluminum alloy, magnesium alloy, nickel alloy, copper alloy, titanium alloy, polymeric, glass, ceramic, polyether ether ketone fiber, polytetrafluoroethylene fiber, carbon fiber, graphite fiber, Kevlar® fiber, silica yarn, glass fiber, hydrogenated nitrile butadiene rubber, composites thereof, and any combination thereof. The elastomeric layer may comprise an elastomeric material selected from the group consisting of ethylene propylene diene monomer rubber, nitrile butadiene, styrene butadiene, butyl rubber, polyethylene rubber, natural rubber, ethylene propylene monomer rubber, peroxide crosslinked ethylene propylene monomer rubber, sulfur crosslinked ethylene propylene monomer rubber, ethylene vinyl acetate rubber, hydrogenized acrylonitrile-butadiene rubber, acrylonitrile butadiene rubber, carboxylated acrylonitrile butadiene rubber, isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, composites thereof, and any combination thereof. The rigid sealing device may be bistable. The rigid sealing device may be non-bistable. At least a portion of at least one of the elastomeric layer or the reinforcing layer may be degradable. At least a portion of the rigid sealing device may be degradable.

Provided are methods of forming a seal in a wellbore in accordance with the disclosure and the illustrated FIGS. An example method comprises introducing a rigid sealing device in the wellbore; wherein the rigid sealing device has an exterior having holes disposed therethrough; wherein an expandable sealing layer is disposed around the rigid sealing device. The expandable sealing layer comprises an elastomeric layer and a reinforcing layer disposed between the elastomeric layer and the exterior of the rigid sealing device. The method further comprises expanding the rigid sealing device, thereby inducing expansion of the expandable sealing layer; wherein the elastomeric layer does not extrude through the holes of the exterior of the rigid sealing device; and contacting an adjacent surface with the expandable sealing layer to form the seal.

Additionally or alternatively, the method may include one or more of the following features individually or in combination. The elastomeric layer may comprise a swellable rubber. The elastomeric layer may comprise a non-swellable rubber. The reinforcing layer may comprise a mesh selected from the group consisting of a chain link mesh, a knitted mesh, a chain mail mesh, a plain double mesh, a twill square mesh, a twill dutch mesh, a reverse plain dutch mesh, a plain dutch mesh, a lock crimp mesh, a double crimp mesh, an intercrimp mesh, a flat top style mesh, or any combination thereof. The elastomeric layer may be bonded to the reinforcing layer. The elastomeric layer may not be bonded to the reinforcing layer. The reinforcing layer may comprise a mesh comprising a material selected from the group consisting of steel, stainless steel, aluminum alloy, magnesium alloy, nickel alloy, copper alloy, titanium alloy, polymeric, glass, ceramic, polyether ether ketone fiber, polytetrafluoroethylene fiber, carbon fiber, graphite fiber, Kevlar® fiber, silica yarn, glass fiber, hydrogenated nitrile butadiene rubber, composites thereof, and any combination thereof. The elastomeric layer may comprise an elastomeric material selected from the group consisting of ethylene propylene diene monomer rubber, nitrile butadiene, styrene butadiene, butyl rubber, polyethylene rubber, natural rubber, ethylene propylene monomer rubber, peroxide crosslinked ethylene propylene monomer rubber, sulfur crosslinked ethylene propylene monomer rubber, ethylene vinyl acetate rubber, hydrogenized acrylonitrile-butadiene rubber, acrylonitrile butadiene rubber, carboxylated acrylonitrile butadiene rubber, isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, composites thereof, and any combination thereof. The rigid sealing device may be bistable. The rigid sealing device may be non-bistable. At least a portion of at least one of the elastomeric layer or the reinforcing layer may be degradable. At least a portion of the rigid sealing device may be degradable.

The preceding description provides various embodiments of the apparatuses, systems, and methods disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

It should be understood that the compositions and methods are described in terms of "comprising," "containing," or "including" various components or steps. The compositions and methods can also "consist essentially of" or "consist of" the various components and steps. Moreover, the indefinite articles "a" or "an," as used in the claims, are defined herein to mean one or more than one of the element that it introduces.

Therefore, the present embodiments are well adapted to attain the ends and advantages mentioned, as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown other than as described in the claims below. Also, the terms in the claims have their plain, ordinary meaning unless otherwise explicitly and clearly defined by the patentee. It is therefore evident that the particular illustrative embodiments disclosed above may be altered or modified, and all such variations are considered within the scope and spirit of the present invention.

What is claimed is:

1. A wellbore sealing system comprising:

a rigid sealing device capable of expansion and having an exterior having holes disposed therethrough; and an expandable sealing layer disposed around the rigid sealing device, the expandable sealing layer comprising:

an elastomeric layer comprising a swellable elastomer; and an expandable reinforcing layer comprising a metal mesh selected from the group consisting of a chain link mesh, a chain mail mesh, a lock crimp mesh, a double crimp mesh, an intercrimp mesh, and any combination thereof.

2. The wellbore sealing system of claim 1, wherein the elastomeric layer comprises a non-swellable rubber.

3. The wellbore sealing system of claim 1, wherein the elastomeric layer is bonded to the reinforcing layer.

4. The wellbore sealing system of claim 1, wherein the elastomeric layer is not bonded to the reinforcing layer.

5. The wellbore sealing system of claim 1, wherein the reinforcing layer comprises a mesh comprising a material selected from the group consisting of steel, stainless steel, aluminum alloy, magnesium alloy, nickel alloy, copper alloy, titanium alloy, and any combination thereof.

6. The wellbore sealing system of claim 1, wherein the elastomeric layer comprises an elastomeric material selected from the group consisting of ethylene propylene diene monomer rubber, nitrile butadiene, styrene butadiene, butyl rubber, polyethylene rubber, natural rubber, ethylene propylene monomer rubber, peroxide crosslinked ethylene propylene monomer rubber, sulfur crosslinked ethylene propylene monomer rubber, ethylene vinyl acetate rubber, hydrogenized acrylonitrile-butadiene rubber, acrylonitrile butadiene rubber, carboxylated acrylonitrile butadiene rubber, isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, composites thereof, and any combination thereof.

7. The wellbore sealing system of claim 1, wherein the rigid sealing device is bistable.

8. The wellbore sealing system of claim 1, wherein the rigid sealing device is non-bistable.

9. The wellbore sealing system of claim 1, wherein at least a portion of at least one of the elastomeric layer or the reinforcing layer is degradable.

10. The wellbore sealing system of claim 1, wherein at least a portion of the rigid sealing device is degradable.

11. A method of forming a seal in a wellbore, the method comprising:

introducing a rigid sealing device in the wellbore; wherein the rigid sealing device has an exterior having holes disposed therethrough; wherein an expandable sealing layer is disposed around the rigid sealing device, the expandable sealing layer comprising:

an elastomeric layer comprising a swellable elastomer; and an expandable; reinforcing layer comprising a metal mesh selected from the group consisting of a chain link mesh, a chain mail mesh, a lock crimp mesh, a double crimp mesh, an intercrimp mesh, and any combination thereof: wherein the reinforcing layer is disposed between the elastomeric layer and the exterior of the rigid sealing device;

expanding the rigid sealing device, thereby inducing expansion of the expandable sealing layer; wherein the elastomeric layer does not extrude through the holes of the exterior of the rigid sealing device; and contacting an adjacent surface with the expandable sealing layer to form the seal.

12. The method of claim 11, wherein the elastomeric sealing layer comprises a non-swellable rubber.

13. The method of claim 11, wherein the rigid sealing device is bistable.

14. The method of claim 11, wherein the rigid sealing device is non-bistable.

15. The method of claim 11, wherein the elastomeric layer is bonded to the reinforcing layer.

16. The method of claim 11, wherein the elastomeric layer is not bonded to the reinforcing layer.

17. The method of claim 11, wherein the reinforcing layer comprises a mesh comprising a material selected from the group consisting of steel, stainless steel, aluminum alloy, magnesium alloy, nickel alloy, copper alloy, titanium alloy, and any combination thereof.

18. The method of claim 11, wherein the elastomeric layer comprises an elastomeric material selected from the group consisting of ethylene propylene diene monomer rubber, nitrile butadiene, styrene butadiene, butyl rubber, polyethylene rubber, natural rubber, ethylene propylene monomer rubber, peroxide crosslinked ethylene propylene monomer rubber, sulfur crosslinked ethylene propylene monomer rubber, ethylene vinyl acetate rubber, hydrogenized acrylonitrile-butadiene rubber, acrylonitrile butadiene rubber, carboxylated acrylonitrile butadiene rubber, isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, composites thereof, and any combination thereof.

19. The method of claim 11, wherein at least a portion of at least one of the elastomeric layer or the reinforcing layer is degradable.

20. The method of claim 11, wherein at least a portion of the rigid sealing device is degradable.

* * * * *